US006668153B2

(12) United States Patent
Sakanobe et al.

(10) Patent No.: US 6,668,153 B2
(45) Date of Patent: Dec. 23, 2003

(54) CLEANING BLADE, CLEANER FOR IMAGE CARRYING BODY, AND IMAGE FORMING APPARATUS

(75) Inventors: Makoto Sakanobe, Ebina (JP); Noriaki Kojima, Ebina (JP); Takashi Fuchiwaki, Ebina (JP); Yasunori Unagida, Ebina (JP); Hiroyuki Koide, Ebina (JP); Yoshinori Nakano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/097,614

(22) Filed: Mar. 15, 2002

(65) Prior Publication Data

US 2003/0086738 A1 May 8, 2003

(30) Foreign Application Priority Data

Nov. 2, 2001 (JP) ..... 2001-338089
Jan. 31, 2002 (JP) ..... 2002-024161

(51) Int. Cl.[7] ..... G03G 21/00
(52) U.S. Cl. ..... 399/350
(58) Field of Search ..... 399/297, 350, 399/351; 256/256.5, 256.51, 256.52

(56) References Cited

U.S. PATENT DOCUMENTS 5,765,088 A * 6/1998 Nakayama et al. ..... 399/350
6,055,404 A * 4/2000 Yamazaki et al. ..... 399/350
6,453,146 B1 * 9/2002 Yamada et al. ..... 399/350
6,522,856 B2 * 2/2003 Nakayama ..... 399/350 X

FOREIGN PATENT DOCUMENTS

JP A 8-62893 3/1996
JP A 8-95286 4/1996

OTHER PUBLICATIONS

"Tensile testing methods vulcanized rubber" Japanese Industrial Standard K 6251:1993, 1998, pp 286–289 (w/English translation).
"Testing methods of rebound resilience for rubber, vulcanized or thermoplastic" Japanese Industrial Standard K 6255:1996, pp309–319 (w/English translation).
"Tear testing methods for vulcanized rubber" Japanese Industrial Standard K 6252:1993, pp290–292 (w/English translation).
"Permanent set testing methods for rubber, vulcanized or thermoplastic," Japanese Industrial Standard K 6262:1997, 1997, pp381–386 (w/English translation).

* cited by examiner

*Primary Examiner*—William J. Royer
(74) *Attorney, Agent, or Firm*—Oliff & Berridge, PLC

(57) ABSTRACT

A cleaning blade of an image forming apparatus is formed of urethane rubber, a modulus of repulsion elasticity (JIS K6255) is not less than 20% at 10° C. to not more than 70% at 40° C., a 300% modulus (JIS K6251) is not less than 200 kgf/cm$^2$, and a tear strength (JIS K6252 crescent type) is not less than 35 kgf/cm. A tension set (JIS K6262) of the cleaning blade (3) is preferably not more than 2.5%, and is more preferably not more than 1.0%, and is still more preferably not more than 0.5%.

7 Claims, 8 Drawing Sheets

FIG. 3

| BLADE | | | A. COMPARATIVE EXAMPLE 1 | | | | | | B. COMPARATIVE EXAMPLE 2 | | | C. EXAMPLE 1 | | |
|---|---|---|---|---|---|---|---|---|---|---|---|---|---|---|
| BLADE MATERIAL CHARAC-TERISTICS | MODULUS OF REPLUSION ELASTICITY (%) | 10°C | 15 | | | | | | 30 | | | 20 | | |
| | | 25°C | 35 | | | | | | 60 | | | 50 | | |
| | | 40°C | 60 | | | | | | 75 | | | 70 | | |
| | 300% MODULUS (kgf/cm$^2$) | | 280 | | | | | | 130 | | | 230 | | |
| | TEAR STRENGTH (kgf/cm) | | 38 | | | | | | 27 | | | 35 | | |
| | TENSION SET (%) | | 3.8 | | | | | | 2.5 | | | 2.5 | | |
| | PUSHING FORCE [ INITIAL VALUE ] (gf/mm) | | 4 | | | 7 | | | 4 | | | 4 | | |
| TEST ATOMOSPHERE (TEMPERATURE/ HUMIDITY) | | | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH |
| CLEANING CHARAC-TERISTICS EVALUATION RESULTS | DEFECTIVE CLEANING (COLOR STRIPE) | | ○ | × | × | ○ | ○ | ○ | × | ○ | ○ | ◎ | ◎ | ◎ |
| | WHITE STREAKS REDUCTION IN DENSITY | | × | ○ | ○ | ○ | ◎ | ◎ | × | ○ | ○ | ◎ | ◎ | ◎ |
| | FILMING OF IMAGE CARRYING BODY | | ○ | ○ | × | ◎ | ◎ | ◎ | ○ | × | ×× | ◎ | ◎ | ◎ |
| | BLADE DAMAGE | | ◎ | ◎ | ◎ | ○ | ○ | ○ | ×× | × | × | ◎ | ◎ | ◎ |
| | BLADE CREAKING (STRANGE SOUND) | | × | ○ | ◎ | ○ | ◎ | ◎ | × | ○ | ◎ | ◎ | ◎ | ◎ |
| | WEAR OF IMAGE CARRYING BODY (LIFE) | | ◎ | ◎ | ◎ | ×× | ×× | ×× | ◎ | ◎ | ◎ | ◎ | ◎ | ◎ |
| | DEFECTIVE CLEANING (COLOR STRIPE) AFTER SETTLING TEST | | × | × | ×× | ○ | ○ | ○ | ○ | ○ | ○ | ○ | ○ | ○ |

FIG. 4

| BLADE | | | A. COMPARATIVE EXAMPLE 1 | | | C. EXAMPLE 1 | | | D1. EXAMPLE 2 | | | D2. EXAMPLE 3 | | | E. EXAMPLE 4 | | |
|---|---|---|---|---|---|---|---|---|---|---|---|---|---|---|---|---|---|
| BLADE MATERIAL CHARACTERISTICS | MODULUS OF REPLUSION ELASTICITY (%) | 10°C | 15 | | | 20 | | | 20 | | | 20 | | | 20 | | |
| | | 25°C | 35 | | | 50 | | | 50 | | | 50 | | | 50 | | |
| | | 40°C | 60 | | | 70 | | | 70 | | | 70 | | | 70 | | |
| | 300% MODULUS (kgf/cm$^2$) | | 280 | | | 230 | | | 205 | | | 205 | | | 205 | | |
| | TEAR STRENGTH (kgf/cm) | | 38 | | | 35 | | | 36 | | | 36 | | | 36 | | |
| | TENSION SET (%) | | 3.8 | | | 2.5 | | | 0.5 | | | 1 | | | 2.7 | | |
| | PUSHING FORCE [ INITIAL VALUE ] (gf/mm) | | 4 | | | 4 | | | 4 | | | 4 | | | 4 | | |
| TEST ATOMOSPHERE (TEMPERATURE/ HUMIDITY) | | | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH |
| CLEANING CHARACTERISTICS EVALUATION RESULTS | DEFECTIVE CLEANING (COLOR STRIPE) | | ○ | × | × | ◎ | ◎ | ◎ | ◎ | ◎ | ◎ | ◎ | ◎ | ◎ | ◎ | ◎ | ◎ |
| | WHITE STREAKS REDUCTION IN DENSITY | | × | ○ | ○ | ◎ | ◎ | ◎ | ◎ | ◎ | ◎ | ◎ | ◎ | ◎ | ◎ | ◎ | ◎ |
| | FILMING OF IMAGE CARRYING BODY | | ○ | ○ | × | ◎ | ◎ | ◎ | ○ | ○ | ○ | ○ | ○ | ○ | ○ | ○ | ○ |
| | BLADE DAMAGE | | ◎ | ◎ | ◎ | ◎ | ◎ | ◎ | ○ | ○ | ○ | ○ | ○ | ○ | ○ | ○ | ○ |
| | BLADE CREAKING (STRANGE SOUND) | | × | ○ | ◎ | ◎ | ◎ | ◎ | ◎ | ◎ | ◎ | ◎ | ◎ | ◎ | ◎ | ◎ | ◎ |
| | WEAR OF IMAGE CARRYING BODY (LIFE) | | ◎ | ◎ | ◎ | ◎ | ◎ | ◎ | ◎ | ◎ | ◎ | ◎ | ◎ | ◎ | ◎ | ◎ | ◎ |
| | DEFECTIVE CLEANING (COLOR STRIPE) AFTER SETTLING TEST | | × | × | ×× | ○ | ○ | ○ | ◎ | ◎ | ◎ | ◎ | ○ | ○ | ○ | × | × |
| | PUSHING POWER AFTER SETTLING TEST (gf/mm) | | 2.8 | | | 3.5 | | | 4 | | | 3.9 | | | 3.4 | | |

FIG. 5

| BLADE | | | A. COMPARATIVE EXAMPLE 1 | | | B. COMPARATIVE EXAMPLE 2 | | | C. EXAMPLE 1 | | | F. COMPARATIVE EXAMPLE 3 | | |
|---|---|---|---|---|---|---|---|---|---|---|---|---|---|---|
| BLADE MATERIAL CHARAC-TERISTICS | MODULUS OF REPLUSION ELASTICITY (%) | 10°C | 15 | | | 30 | | | 20 | | | 20 | | |
| | | 25°C | 35 | | | 60 | | | 50 | | | 50 | | |
| | | 40°C | 60 | | | 75 | | | 70 | | | 70 | | |
| | 300% MODULUS (kgf/cm$^2$) | | 280 | | | 130 | | | 230 | | | 195 | | |
| | TEAR STRENGTH (kgf/cm) | | 38 | | | 27 | | | 35 | | | 36 | | |
| | TENSION SET (%) | | 3.8 | | | 2.5 | | | 2.5 | | | 2.5 | | |
| | PUSHING FORCE [ INITIAL VALUE ] (gf/mm) | | 4 | | | 4 | | | 4 | | | 4 | | |
| TEST ATOMOSPHERE (TEMPERATURE/ HUMIDITY) | | | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH |
| CLEANING CHARAC-TERISTICS EVALUATION RESULTS | DEFECTIVE CLEANING (COLOR STRIPE) | | ○ | × | × | × | ○ | ○ | ◎ | ◎ | ◎ | ◎ | ◎ | ◎ |
| | WHITE STREAKS REDUCTION IN DENSITY | | × | ○ | ○ | × | ○ | ○ | ◎ | ◎ | ◎ | ◎ | ◎ | ◎ |
| | FILMING OF IMAGE CARRYING BODY | | ○ | ○ | × | ○ | × | ×× | ◎ | ◎ | ◎ | ○ | ○ | × |
| | BLADE DAMAGE | | ◎ | ◎ | ◎ | ×× | × | × | ◎ | ◎ | ◎ | × | ○ | ○ |
| | BLADE CREAKING (STRANGE SOUND) | | × | ○ | ◎ | × | ○ | ◎ | ◎ | ◎ | ◎ | ◎ | ◎ | ◎ |
| | WEAR OF IMAGE CARRYING BODY (LIFE) | | ◎ | ◎ | ◎ | ◎ | ◎ | ◎ | ◎ | ◎ | ◎ | ◎ | ◎ | ◎ |
| | DEFECTIVE CLEANING (COLOR STRIPE) AFTER SETTLING TEST | | × | × | ×× | ○ | ○ | ○ | ○ | ○ | ○ | ○ | ○ | ○ |

FIG. 6

| BLADE | | | G. COMPARATIVE EXAMPLE 4 | | | H. EXAMPLE 5 | | | I. EXAMPLE 6 | | | J. COMPARATIVE EXAMPLE 5 | | |
|---|---|---|---|---|---|---|---|---|---|---|---|---|---|---|
| BLADE MATERIAL CHARAC-TERISTICS | MODULUS OF REPLUSION ELASTICITY (%) | 10°C | 20 | | | 20 | | | 20 | | | 20 | | |
| | | 25°C | 50 | | | 50 | | | 50 | | | 55 | | |
| | | 40°C | 70 | | | 70 | | | 70 | | | 75 | | |
| | 300% MODULUS (kgf/cm$^2$) | | 200 | | | 200 | | | 200 | | | 200 | | |
| | TEAR STRENGTH (kgf/cm) | | 34 | | | 40 | | | 36 | | | 36 | | |
| | TENSION SET (%) | | 2.5 | | | 2.5 | | | 2.5 | | | 2.5 | | |
| | PUSHING FORCE [ INITIAL VALUE ] (gf/mm) | | 4 | | | 4 | | | 4 | | | 4 | | |
| TEST ATOMOSPHERE (TEMPERATURE/ HUMIDITY) | | | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH | 28°C 85% RH | 22°C 55% RH | 10°C 15% RH |
| CLEANING CHARAC-TERISTICS EVALUATION RESULTS | DEFECTIVE CLEANING (COLOR STRIPE) | | ◎ | ◎ | ◎ | ◎ | ◎ | ◎ | ◎ | ◎ | ◎ | × | ◎ | ◎ |
| | WHITE STREAKS REDUCTION IN DENSITY | | ◎ | ◎ | ◎ | ◎ | ◎ | ◎ | ◎ | ◎ | ◎ | ◎ | ◎ | ◎ |
| | FILMING OF IMAGE CARRYING BODY | | ○ | ○ | × | ◎ | ◎ | ◎ | ○ | ○ | ○ | ○ | ○ | ○ |
| | BLADE DAMAGE | | × | ○ | ○ | ◎ | ◎ | ◎ | ○ | ○ | ○ | ×× | ○ | ○ |
| | BLADE CREAKING (STRANGE SOUND) | | ◎ | ◎ | ◎ | ◎ | ◎ | ◎ | ◎ | ◎ | ◎ | ◎ | ◎ | ◎ |
| | WEAR OF IMAGE CARRYING BODY (LIFE) | | ◎ | ◎ | ◎ | ◎ | ◎ | ◎ | ◎ | ◎ | ◎ | ◎ | ◎ | ◎ |
| | DEFECTIVE CLEANING (COLOR STRIPE) AFTER SETTLING TEST | | ○ | ○ | ○ | ○ | ○ | ○ | ○ | ○ | ○ | ○ | ○ | ○ |

FIG. 7

| SF | 115 | 130 | 140 | 145 |
|---|---|---|---|---|
| CLEANING PERFORMANCE (STRESS CONDITION) COMPARATIVE BLADE | NG SEVERAL HUNDREDS SLIPPING-THROUGH | NG SEVERAL TENS SLIPPING-THROUGH | NG SEVERAL SLIPPING-THROUGH | OK NO SLIPPING-THROUGH |
| CLEANING PERFORMANCE (STRESS CONDITION) BLADE OF THE INVENTION | OK NO SLIPPING-THROUGH | OK NO SLIPPING-THROUGH | OK NO SLIPPING-THROUGH | OK NO SLIPPING-THROUGH |

CLEANING BLADE, CLEANER FOR IMAGE CARRYING BODY, AND IMAGE FORMING APPARATUS

BACKGROUND OF THE INVENTION

1. Field of Invention

The present invention relates to an image forming apparatus such as a copying machine, a printer, a facsimile device, a composite machine, or the like, employing a xerography method or an electrostatic recording method, and a cleaner and a cleaning blade used in the image forming apparatus and, more particularly, an image forming apparatus capable of preventing generation of the defective cleaning when almost spherical toners are employed as the developer and a cleaner and a cleaning blade.

2. Description of Related Art

As the almost spherical toner cleaning method in the prior art, the method of employing the almost spherical toners and the unshaped toners that are mixed at a particular rate (for example, JP-A-Hei.8-62893, JP-A-Hei.8-95286) is proposed. However, in the case of such method, since the almost spherical toners also pass through clearances between the unshaped toners to go to the blade edge portion, the improvement in the defective cleaning of the almost spherical toners is not sufficient.

The inventors of the present invention thought the above defective cleaning could be overcome by using a cleaning blade having a high rebound resilience, and then made the study.

As the result of the study of the inventors of the present invention, it is found that, if the modulus of repulsion elasticity of a cleaning blade made of a urethane rubber is not less than 20% in a low-temperature/low-humidity atmosphere, the above drawback can be improved. In such case, however, if the modulus of repulsion elasticity in the low-temperature/low-humidity atmosphere is set too high, sometimes a broken edge or the turned-up edge of the cleaning blade is generated due to the change in the rubber characteristics, in a high-temperature/high-humidity (28° C., 85% RH) atmosphere.

In order to prevent the broken edge, of the cleaning blade made of a urethane rubber in the above high-temperature/high-humidity atmosphere, the inventors of the present invention have confirmed as the results of the studies, if the blade having the modulus of repulsion elasticity of not less than 20% at 10° C. and not more than 70% at 40° C. is employed, both the defective cleaning in the low-temperature/low-humidity atmosphere and the broken edge of the cleaning blade in the high-temperature/high-humidity atmosphere can be improved. However, in the cleaning blade whose modulus of repulsion elasticity is within the above range, such cleaning blade can merely attain the improvement of the drawback but cannot get to the settlement. Therefore, the inventors of the present invention repeated earnestly the study and the examination confirmed that, since the value of either the 300% modulus or the tear strength of the cleaning blade or both values of them are still low, the above drawback has not been overcome.

Also, if the cleaning blade that is pushed against the image carrying body is used for a long time in the high-temperature and high-humidity atmosphere, such cleaning blade is set permanently (settling). If the cleaning blade is set, the pushing force of the cleaning blade against the image carrying body is lowered. Thus, there is the problem that the defective cleaning is generated. The inventors of the present invention made the studies and the examinations about this problem, and then confirmed that the above problem can be overcome by suppressing the permanent elongation of the cleaning blade.

SUMMARY OF THE INVENTION

The present invention has been made in view of the above problem and studies, and has a following content (1) as a subject.

(1) To provide a cleaning blade, a cleaner, and an image forming apparatus capable of preventing sufficiently the defective cleaning of almost spherical toners without fail from the low-temperature and low-humidity atmosphere to the high-temperature and high-humidity atmosphere.

Next, the present invention created to overcome the above subjects will be explained hereunder. In order to facilitate the correspondence to elements of Examples described later, symbols of the elements in the Examples that are given in parenthesis are added to the elements of the present invention. In this case, the reason for explaining the present invention to correlate with the symbols of the Examples described later is to make the understanding of the present invention easy, and not to intend to limit the scope of the present invention to the Examples.

In order to overcome the above subject, a cleaning blade (3) according to a first aspect of the invention has a blade top end portion for frictionally contacting with a surface of an image carrying body (PRy to PRk, B) to remove residual toners on the surface when the surface rotating passes through a cleaning area. The cleaning blade (3) is made of elastic material. The cleaning blade (3) is formed of urethane rubber. A modulus of repulsion elasticity (JIS K6255) of the cleaning blade (3) is not less than 20% at 10° C. and not more than 70% at 40° C. A 300% modulus (JIS K6251) of the cleaning blade (3) is not less than 200 kgf/cm$^2$. A tear strength (JIS K6252 crescent type) of the cleaning blade (3) is more than 35 kgf/cm.

In the cleaning blade (3) of the present invention, a tension set (JIS K6262) is preferably not more than 2.5% (a second aspect of the invention), more preferably not more than 1.0%, and still more preferably not more than 0.5%.

Normally, if the shape factor SF of the toner used in the image forming apparatus (U) is SF<140, the defective cleaning is ready to occur as the SF (shape factor) value is reduced. Also, in the cleaning blade (3) in the prior art, in order to assure the cleaning performance in the low-temperature and low-humidity atmosphere, the pushing force of the cleaning blade (3) against the photoreceptors (PRy to PRk, B) must be increased. However, there is the problem that, if the pushing force is increased, the worn amount of the surface layer of the photoreceptors (PRy to PRk, B) is increased and thus the life of the photoreceptors (PRy to PRk, B) is shortened.

However, in the cleaning blade (3) of the present invention having the above configuration, since the cleaning blade (3) having the modulus of repulsion elasticity (JIS K6255) of 20% at 10° C. and 40% at 40° C. is used, the temperature dependency (variation) is small. In this case, if the cleaning blade (3) having the relatively high modulus of repulsion elasticity on the low temperature side is used to improve the cleaning characteristic in the low-temperature and low-humidity atmosphere, the modulus of repulsion elasticity on the high temperature side can be set to the relatively low value. As a result, since the material having the relatively high modulus of repulsion elasticity on the low temperature side can be employed, the cleaning performance can be assured unless the pushing force applied on the low temperature side is enhanced. Also, since the modulus of repulsion elasticity on the high temperature side is suppressed, the burr or the break of the cleaning blade (3) caused in the high-temperature and high-humidity atmosphere can be suppressed.

Also, in the present invention, the 300% modulus (JIS K6251) is 230 kgf/cm$^2$, and the tear strength (JIS K6252 crescent type) is 35 kgf/cm. In this manner, if the 300% modulus and the tear strength are high, the minute chip of the cleaning blade (3) can be suppressed and particularly the cleaning performance at SF<140 can be improved.

In addition, the cleaning blade (3) having the tension set (JIS K6262) of 2.5% is employed. Therefore, the reduction (attenuation) in the pushing force against the photoreceptors (PRy to PRk, B) is small even after the cleaning blade (3) is left as it is for a long time in the high-temperature and high-humidity atmosphere, and thus the cleaning performance can be assured.

Also, if the material of the cleaning blade (3) is selected with regard to the characteristics of the blade materials, as described above, the necessity for increasing the pushing force against the photoreceptors (PRy to PRk and the intermediate transfer belt (B) to assure the cleaning performance can be eliminated. Thus, since the cleaning performance can be maintained in all application circumstances, the worn amount of the photoreceptors (PRy to PRk) and the intermediate transfer belt (B) can be reduced. In addition, in the situation that the friction coefficient of the surfaces of the photoreceptors (PRy to PRk, B) is increased because the discharge product is adhered onto the surfaces of the photoreceptors (PRy to PRk, B) or the surfaces thereof are changed in quality, the noise (creaking) due to the vibration of the cleaning blade (3) can be reduced.

According to a third aspect of the invention, a cleaner for image carrying body, has a cleaning blade (3) having a blade top end portion for frictionally contacting with a surface of an image carrying body (PRy to PRk) to remove residual toners on the surface when the surface passes through a cleaning area. The cleaning blade (3) is made of elastic material. The cleaning blade (3) is formed of urethane rubber. A modulus of repulsion elasticity (JIS K6255) of the cleaning blade (3) is not less than 20% at 10° C. and not more than 70% at 40° C. A 300% modulus (JIS K6251) of the cleaning blade (3) is not less than 200 kgf/cm$^2$. A tear strength (JIS K6252 crescent type) of the cleaning blade (3) is more than 35 kgf/cm. The cleaning blade (3) removes a toner adhering to the surface of the image carrying body (PRy to PRk) on which a toner image is formed.

The cleaner for the image carrying body of the present invention having the above configuration cleans the residual toners adhered onto the surfaces of the image carrying bodies (PRy, PRm, PRc, PRk, B) such as the photoreceptors (PRy to PRk), the intermediate transfer belt (B), by the cleaning blade (3).

According to a fourth aspect of the invention, an image forming apparatus has:

a photoreceptor (PRy to PRk);

a charging unit (CRy to CRk);

an electrostatic latent image formning unit (ROS);

a developing unit (Gy to Gk);

a transferring unit (T1*y* to T1*k*); and a photoreceptor cleaner (CLy to CLk).

The photoreceptor (PRy to PRk) passes through a charging area in which a surface thereof rotating is charged, a latent image writing position (Q1*y* to Q1*k*) in which a light is irradiated thereto in response to an image, a developing area (Q2*y* to Q2*k*) opposing to the developing unit, a transferring area (Q3*y* to Q3*k*), and a cleaning area sequentially. The charging unit (CRy to CRk) charges a surface of the photoreceptor (PRy to PRk) passing through the charging area. The electrostatic latent image forming unit (ROS) forms an electrostatic latent image on the surface of the charged photoreceptors (PRy to PRk) passing through the latent image writing position (Q1*y* to Q1*k*). The developing unit (Q2*y* to Q2*k*) develops the electrostatic latent image on the surface of the photoreceptor (PRy to PRk) passing through the developing area (Q2*y* to Q2*k*) into a toner image. The transferring unit (T1*y* to T1*k*) transfers the toner image on the surface of the photoreceptor (PRy to PRk) passing through the transferring area (Q3*y* to Q3*k*) onto a transfer material. The photoreceptor cleaner (CLy to CLk) has the cleaning blade (3) and cleans a toner adhered to the surface of the photoreceptor (PRy to PRk) on which the toner image is formed by the cleaning blade (3). The cleaning blade (3) has a blade top end portion for frictionally contacting with the surface of the photoreceptor (PRy to PRk) to remove the toner adhering to the surface when the surface passes through the cleaning area. The cleaning blade (3) is made of elastic material. The cleaning blade (3) is formed of urethane rubber. A modulus of repulsion elasticity (JIS K6255) of the cleaning blade (3) is not less than 20% at 10° C. and not more than 70% at 40° C. A 300% modulus (JIS K6251) of the cleaning blade (3) is not less than 200 kgf/cm$^2$. A tear strength (JIS K6252 crescent type) of the cleaning blade (3) is more than 35 kgf/cm.

According to a sixth aspect of the invention, in the image forming apparatus according to the fourth aspect, the developing unit (Gy to Gk) may employ a toner having shape factor SF less than 140. The shape factor SF is expressed by $$SF=[M^2/(A\times 4\pi)]\times 100$$

where M is a maximum circumferential length of a toner particle and A is a projected area of the toner particle.

Since the image forming apparatus according to the fourth aspect of the invention, employs the cleaning blade (3) of the present invention, there is no necessity that the pushing force against the image carrying bodies (PRy to PRk, B) such as the photoreceptors (PRy to PRk) must be increased to assure the cleaning performance, and the worn amount of the photoreceptors (PRy to PRk) can be reduced since the cleaning performance can be assured in all application atmospheres.

Accordingly, assume that the maximum circumferential length of the toner particle is M and the projected area of the particle is A, an image with the high picture quality can be formed not to generate the defective cleaning even when the developing units (Gy to Gk) using the toners having shape factor SF expressed by $SF=[M^2/(A\times 4\pi)]\times 100$ less than 140 are employed.

According to a fifth aspect of the invention, an image forming apparatus of the present invention may have:

a photoreceptor (PRy to PRk);

a charging unit (CRy to CRk);

an electrostatic latent image forming unit (ROS);

a developing unit (Gy to Gk;

an intermediate transferring body (B);

a primary transferring unit (T1*y* to T1*k*);

a secondary transferring unit (T2); and an intermediate transferring body cleaner (CLb).

The photoreceptor (PRy to PRk) passes through a charging area in which a surface thereof is charged, a latent image writing position (Q1*y* to Q1*k*) in which a light is irradiated thereto in response to an image, a developing area (Q2*y* to Q2*k*) opposing to the developing unit (Gy to Gk), a primary transferring area (Q3*y* to Q3*k*), and a photoreceptor cleaning area sequentially. The charging unit (CRy to CRk) charges the surface of the photoreceptors (PRy to PRk) passing through the charging area. The electrostatic latent image forming unit (ROS) forms an electrostatic latent image on the surface of the charged photoreceptor (PRy to PRk) passing through the latent image writing position (Q1*y* to Q1*k*). The developing unit (Gy to Gk) develops the electrostatic latent image on the surface of the photoreceptor (PRy to PRk) passing through the developing area (Q2*y* to Q2*k*) into a toner image. The intermediate transferring body (B) passes through the primary transferring area (Q3*y* to Q3*k*) in which the intermediate transferring body (B) comes into contact with the surface of the photoreceptor (PRy to PRk) and the toner image on the surface of the photoreceptor (PRy to PRk) is primarily transferred thereonto, a secondary transferring area (Q4) in which the toner image being primarily transferred is secondarily transferred onto a recording sheet (S), and the intermediate transferring body cleaning area in which a surface thereof is cleaned sequentially. The primary transferring unit (T1*y* to T1*k*) transfers the toner image on the surface of the photoreceptor (PRy to PRk) passing through the primary transferring area (Q3*y* to Q3*k*) onto the intermediate transferring body (B). The secondary transferring unit (T2) transfers the toner image on a surface of the intermediate transferring body (B) passing through the secondary transferring area (Q4) onto the recording sheet (S). The intermediate transferring body cleaner (CLb) has a cleaning blade (3) and cleans a toner adhering to the surface of the intermediate transferring body (B) by the cleaning blade (3) in the intermediate transferring body cleaning area. The cleaning blade (3) has a blade top end portion for frictionally contacting with the surface of the photoreceptor (PRy to PRk) to remove the toner adhering to the surface when the surface passes through the cleaning area. The cleaning blade (3) is made of elastic material. The cleaning blade (3) is formed of urethane rubber. A modulus of repulsion elasticity (JIS K6255) of the cleaning blade (3) is not less than 20% at 10° C. and not more than 70% at 40° C. A 300% modulus (JIS K6251) of the cleaning blade (3) is not less than 200 kgf/cm$^2$. A tear strength (JIS K6252 crescent type) of the cleaning blade (3) is more than 35 kgf/cm.

According to a seventh aspect of the invention, in the image forming apparatus according to the fifth aspect of the invention, the developing unit (Gy to Gk) may employ a toner having shape factor SF less than 140. The shape factor SF is expressed by $$SF=[M^2/(A\times 4\pi)]\times 100$$

where M is a maximum circumferential length of a toner particle and A is a projected area of the toner particle.

Since the image forming apparatus according to the fifth aspect of the invention, employs the cleaning blade (3) of the present invention, there is no necessity that the pushing force against the intermediate transferring body (B) must be increased to assure the cleaning performance, and the worn amount of the intermediate transferring body (B) can be reduced since the cleaning performance can be assured in all application atmospheres.

Accordingly, assume that the maximum circumferential length of the toner particle is M and the projected area of the particle is A, an image with the high picture quality can be formed not to generate the defective cleaning even when the developing units (Gy to Gk) using the toners having shape factor SF expressed by $SF=[M^2/(A\times 4\pi)]\times 100$ less than 140 are employed.

According to an eighth aspect of the invention, the image forming apparatus according to the fourth aspect of the invention may have:

a sheet carrying belt for carrying the recording sheet (S), on which the toner image formed on the surfaces of the photoreceptors (PRy to PRk) is transferred, into the transferring areas (Q3*y* to Q3*k*); and a sheet carrying belt cleaner having the cleaning blade (3) according to the first or second aspect of the invention, and for cleaning the toners, which are adhered onto a surface of the sheet carrying belt, by the cleaning blade (3).

Since the image forming apparatus according to the eighth aspect of the invention, employs the cleaning blade (3) of the present invention, there is no necessity that the pushing force against the sheet carrying belt must be increased to assure the cleaning performance. Also, since the cleaning performance can be assured in all application atmospheres, the worn amount of the sheet carrying belt can be reduced. Accordingly, even if the developing units (Gy to Gk) using the toners having shape factor less than 140 are employed, an image with the high picture quality can be formed without the generation of the defective cleaning.

According to a ninth aspect of the invention, the image forming apparatus according to the fifth aspect of the invention may have a secondary transferring unit cleaner having the cleaning blade (3) and for cleaning the toners, which are adhered onto a surface of the secondary transferring unit (T2), by the cleaning blade (3).

Since the image forming apparatus according to the ninth aspect of the invention employs the cleaning blade (3) of the present invention, there is no necessity that the pushing force against the secondary transferring unit (T2) must be increased to assure the cleaning performance. Also, since the cleaning performance can be assured in all application atmospheres, the worn amount of the secondary transferring unit (T2) can be reduced. Accordingly, even if the developing units (Gy to Gk) using the toners having shape factor less than 140 are employed, an image with the high picture quality can be formed without the generation of the defective cleaning.

BRIEF DESCRIPTION OF THE DRAWINGS

FIG. 3 is a table showing test results of cleaning characteristics with respect to the pushing force of the cleaning blade (3) and the blade material characteristics at 10° C., 25° C., 40° C.

FIG. 4 is a table showing test results of the pushing force after the settling test and cleaning characteristics (defective cleaning) with respect to the tension set (JIS K6262) after the settling test of the cleaning blade (3) is executed.

FIG. 5 is a table showing test results of cleaning characteristics with respect to the modulus of repulsion elasticity, the 300% modulus, the tear strength of the cleaning blade (3).

FIG. 6 is a table showing test results of cleaning characteristics with respect to the modulus of repulsion elasticity, the 300% modulus, the tear strength of the cleaning blade (3).

FIG. 7 is a table showing the toner slipping-through states of the cleaning blade in the prior art and the cleaning blade (3) of the present invention with respect to various toners that have different shape factors.

DETAILED DESCRIPTION OF PREFERRED EMBODIMENTS

EXAMPLES

Next, particular examples (Examples) of embodiments of the present invention will be explained with reference to Figures hereinafter. In this case, the present invention is not limited to the following embodiments.

Example 1

Figure 1:
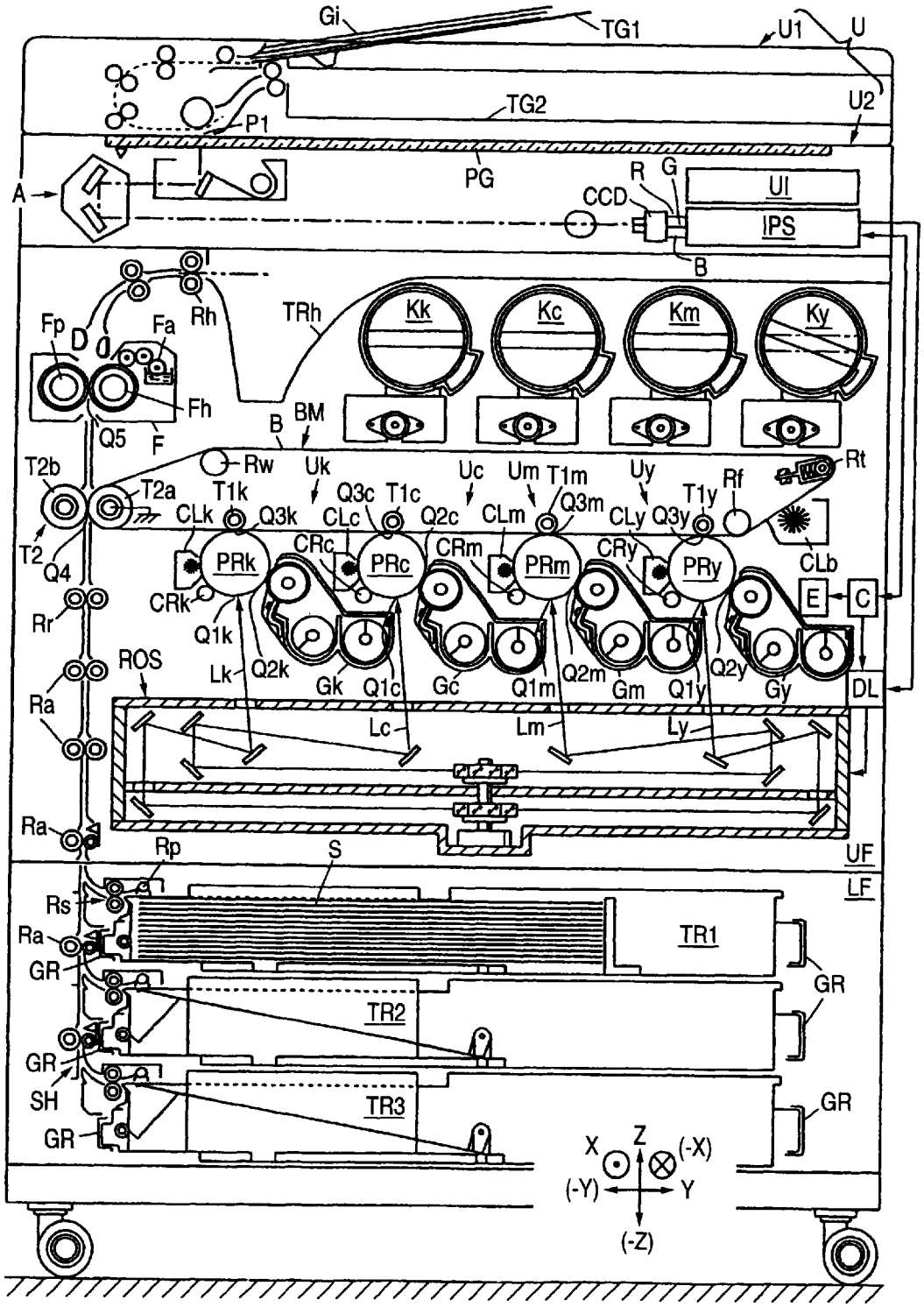
FIG. 1 is a sectional view of an Example 1 of an image forming apparatus of the present invention.

FIG. 1 is a sectional view of an Example 1 of an image forming apparatus of the present invention.

In FIG. 1, the image forming apparatus U comprises an automatic document carrying unit U1, and an image forming apparatus main body (copying machine) U2 that supports this unit U1 and has a platen glass PG at its top end.

The automatic document carrying unit U1 comprises a document paper feed tray TG1 on which a plurality of documents Gi to be copied are set and loaded, and a document paper discharge tray TG2 from which the documents Gi are discharged after such documents are carried from the document paper feed tray TG1 through a copying position (document reading position) P1 on the platen glass PG.

The image forming apparatus main body U2 comprises a U1 (user interface) that is operated by the user to input operation command signals such as copy start, an exposing optical system A.

The reflected light from the document Gi, which is carried over the document reading position P1 on the platen glass PG by the automatic document carrying unit U1, or the document (not shown), which is put on the platen glass PG manually, is converted into R (red), G (green), B (blue) electric signals by a CCD (solid state image sensing device) via the exposing optical system A.

An IPS (image processing system) converts the RGB electric signals input from the CCD into K (black), Y (yellow), M (magenda), C (cyaogen) image data to store temporarily, and then outputs the image data to a laser driving circuit DL at predetermined timings as latent image forming image data.

In this case, if the document image is monochromatic, only the K (black) image data is input into the laser driving circuit DL.

The laser driving circuit DL has respective laser driving circuits (not shown) for respective Y, M, C, K colors, and outputs laser driving signals to respective color latent image writing laser diodes (not shown) of the latent image forming optical system (electrostatic latent image forming unit) ROS in response to the input image data at predetermined timings.

Toner image forming units Uy, Um, Uc, Uk arranged over the ROS are units that form respectively the toner images of Y (yellow), M (magenta), C (cyanogen), and K (black) colors.

Y, M, C, K laser beams Ly, Lm, Lc, Lk emitted from the laser diodes (not shown) of the electrostatic latent image forming unit ROS are input into rotating photoreceptors (image carrying bodies) PRy, PRm, PRc, PRk respectively.

The Y toner image forming unit Uy has a rotating photoreceptor PRy, a charging roller (charger) CRy as the charger, a developing unit Gy, a primary transfer roller (transferring unit) T1*y*, and a cleaner CLy. The toner image forming units Um, Uc, Uk are constructed similarly to the Y toner image forming unit Uy.

The photoreceptors PRy, PRm, PRc, PRk are charged uniformly by the charging rollers CRy, CRm, CRc, CRk respectively, and then the electrostatic latent image is formed on image writing positions (latent image writing positions) Q1*y*, Q1*m*, Q1*c*, Q1*k* of the surface thereof by the laser beams Ly, Lm, Lc, Lk. The electrostatic latent image formed on the surfaces of the photoreceptors PRy, PRm, PRc, PRk is developed into the toner image in developing areas Q2*y*, Q2*m*, Q2*c*, Q2*k* by the developers Gy, Gm, Gc, Gk.

The developed toner image is carried into primary transferring areas Q3*y*, Q3*m*, Q3*c*, Q3*k* that come into contact with an intermediate transfer belt (transfer material; intermediate transferring body; image carrying body) B. Then, the primary transferring voltage, the polarity of which is opposite to the charged polarity of the toners, is applied to primary transfer rollers T1*y*, T1*m*, T1*c*, T1*k*, which are arranged on the back surface side of the intermediate transfer belt (image carrying body) B in the primary transferring areas Q3*y*, Q3*m*, Q3*c*, Q3*k*, at a predetermined timing from a power supply circuit E that is controlled by a controller C.

The toner image formed on respective photoreceptors (image carrying bodies) PRy to PRk is primary-transferred onto the intermediate transfer belt (image carrying body) B by the primary transfer rollers T1*y*, T1*m*, T1*c*, T1*k*. Residual toners on the surfaces of the photoreceptors PRy, PRm, PRc, PRk that are subjected to the primary transfer are cleaned by photoreceptor cleaners CLy, CLm, CLc, CLk.

A belt module BM, which can be moved vertically and be pulled out forward, is arranged over the photoreceptors PRy to PRk. The belt module BM has the intermediate transfer belt B, belt supporting rollers (Rt, Rw, Rf, T2*a*) containing a tension roller Rt, a walking roller Rw, an idler roller (free roller) Rf, and a backup roller T2*a* also serving as a driving roller, the primary transfer rollers T1*y*, T1*m*, T1*c*, T1*k*, and a belt cleaner (intermediate transferring body cleaner) CLb. Then, the intermediate transfer belt B is supported by the belt supporting rollers (Rt, Rw, Rf, T2*a*) rotatably and movably. Accordingly, an intermediate transferring belt driving unit, i.e., a transfer member carrying unit (Rt, Rw, Rf, T2*a*) for carrying the intermediate transfer material (intermediate transferring belt) is constructed by driving devices, which rotate and drive the backup roller T2*a* serving also as the driving roller, the belt supporting rollers (Rt, Rw, Rf, T2*a*), and others.

A secondary transfer roller T2*b* is arranged to oppose to the surface of the intermediate transfer belt B that contacts to the backup roller T2*a*. A secondary transfer unit T2 is constructed by the above rollers T2*a*, T2*b*. Also, a secondary transferring area Q4 is formed in the area that opposes to the secondary transfer roller T2*b* and the intermediate transfer belt B.

Color toner images that are transferred onto the intermediate transfer belt B sequentially in the primary transferring areas Q3*y*, Q3*m*, Q3*c*, Q3*k* by the transferring units T1*y*, T1*m*, T1*c*, T1*k* to superpose are carried into the secondary transferring area Q4.

A pair of three-stage guide rails GR, GR that support the paper feed trays TR1 to TR3 to push in and pull out in the longitudinal direction (X-axis direction) are provided below the ROS. Recording sheets (transferred members) S in the paper feed trays TR1 to TR3 are picked up by a pickup roller Rp, then separated by a separating roller one by one, and then fed to a registration roller Rr by a plurality of carrying rollers Ra. The sheet carrying rollers Ra are provided in plural along a sheet carrying path SH that is formed by the sheet guides. The registration roller Rr is arranged on the upstream side of the secondary transferring area Q4 in the sheet carrying direction. A sheet carrying unit (SH+Ra+Rr) is constructed by the sheet carrying path SH, the sheet carrying rollers Ra, the registration roller Rr.

The registration roller Rr carries the recording sheet S into the secondary transferring area Q4 at the same timing at which the color toner image formed on the intermediate transfer belt B is carried into the secondary transferring area Q4. When the recording sheet S is passed through the secondary transferring area Q4, the backup roller T2*a* is grounded and then the secondary transferring voltage that has the opposite polarity to the charged polarity of the toners is applied to the secondary transfer roller T2*b* from the power supply circuit E, which is controlled by the controller C, at the predetermined timings. At this time, the color toner image on the intermediate transfer belt B is transferred onto the recording sheet S by the secondary transfer unit T2.

After the secondary transfer, the intermediate transfer belt B is cleaned by the belt cleaner CLb.

The recording sheet S on which the toner image is secondary-transferred are carried into a fixing area Q5 that is a pressure-contact area between a heating roller Fh and a pressure roller Fp of a fixing unit F, then heated/fixed when they are passed through the fixing area Q5, and then discharged from a discharging roller Rh into a paper discharge tray TRh.

In this case, a release agent that improves the releasability of the recording sheet S from the heating roller is coated on a surface of the heating roller Fh by a release agent coating unit Fa.

Toner cartridges Ky, Km, Kc, Kk in which Y (yellow), M (magenta), C (cyanogen), and K (black) toners are contained respectively are arranged over the belt module BM. The toners contained in the toner cartridges Ky, Km, Kc, Kk are supplied from the toner supply path (not shown) to the developers Gy, Gm, Gc, Gk in response to the consumption of the toners in the developers Gy, Gm, Gc, Gk.

In FIG. 1, the image forming apparatus U has an upper frame UF and a lower frame LF. The ROS and the members that are arranged over the ROS (the photoreceptors PRy, PRm, PRc, PRk, the developers Gy, Gm, Gc, Gk, the belt module BM) are supported on the upper frame UF.

Also, the guide rails GR that support the paper feed trays TR1 to TR3 and the paper feeding members that feed the papers from the trays TR1 to TR3 (the pickup roller Rp, the separating roller Rs, the sheet carrying roller Ra) are supported onto the lower frame LF.

(Photoreceptor Cleaner)

Figure 2:
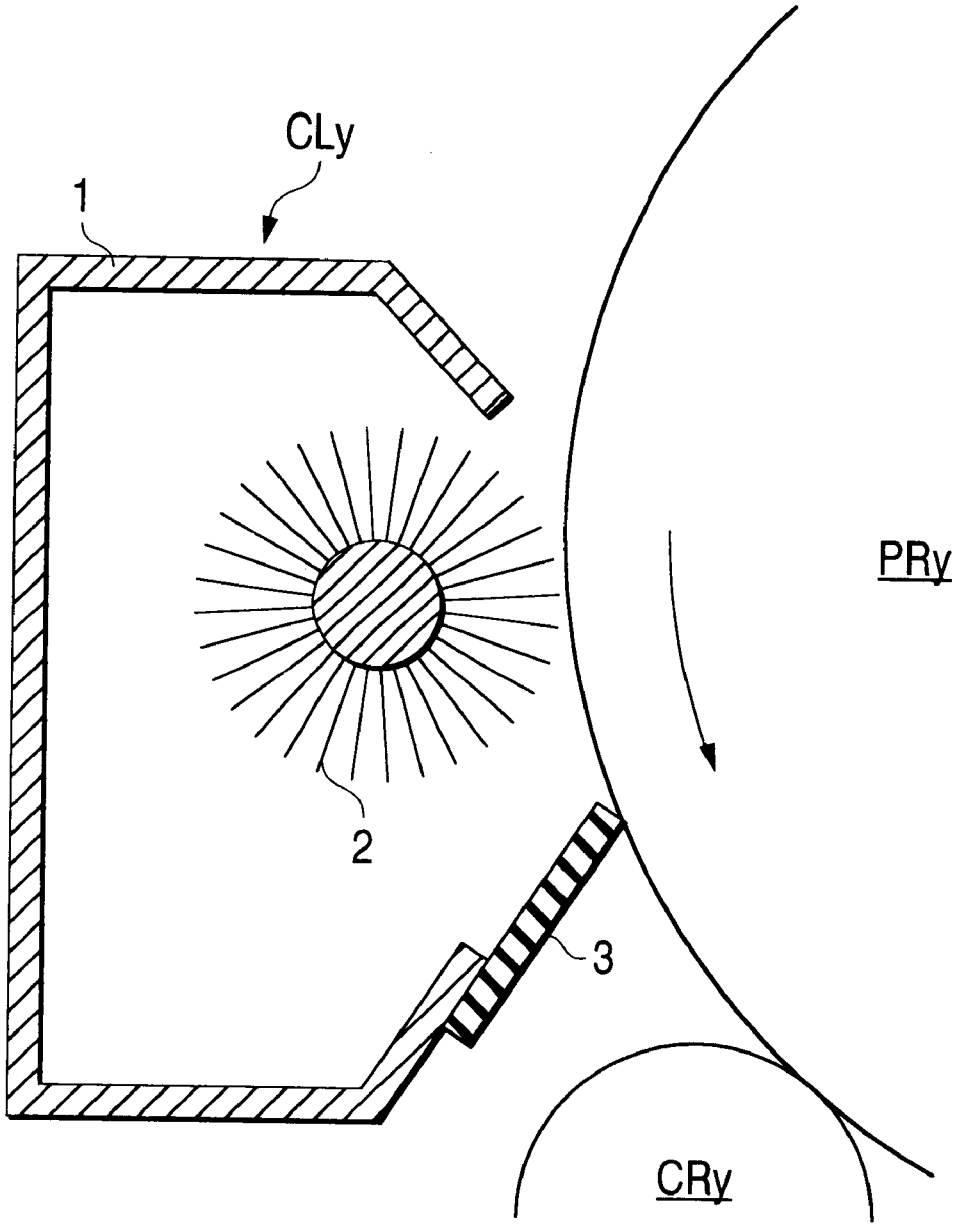
FIG. 2 is a sectional view of a photoreceptor cleaner of the image forming apparatus according to the Example 1 of the present invention.

FIG. 2 is a sectional view of a photoreceptor cleaner of the image forming apparatus according to the Example 1 of the present invention.

In the following explanation, since the photoreceptor cleaners CLy, CLm, CLc, CLk have the same configuration, only the photoreceptor cleaner CLy will be explained and thus their detailed explanations of other photoreceptor cleaners CLm, CLc, CLk will be omitted hereunder. Also, since the belt cleaner CLb is constructed similarly to the photoreceptor cleaner CLy, its detailed explanation will be omitted hereunder.

In FIG. 2, the photoreceptor cleaner CLy has a cleaner vessel 1. A cleaning brush 2 that is brought into contact with the photoreceptor PRy to recover the residual toners on the surface of the photoreceptor PRy is provided to the cleaner vessel 1. Then, a cleaning blade 3 is provided on the downstream side of the cleaning brush 2 in the rotating direction of the photoreceptor PRy such that its top end portion comes into contact with the photoreceptor PRy. A base end portion of the blade 3 is supported in the situation that such base end portion is fixed to the cleaner vessel 1.

(Cleaning Blade)

The cleaning blade 3 in the Example 1 is formed of urethane rubber as an elastic material, and has the following characteristic values.

The modulus of repulsion elasticity at 10° C.=20%

The modulus of repulsion elasticity at 25° C.=50%

The modulus of repulsion elasticity at 40° C.=70%

The 300% modulus=230 kgf/cm$^2$

The tear strength=35 kgf/cm$^2$

The tension set after maintained in the high-temperature and the high-humidity=2.5%

In this case, the pushing force of the cleaning blade 3 against the photoreceptor PRy is set to 4 gf/mm.

Respective characteristic values of the cleaning blade 3 can be set in the following range.

The modulus of repulsion elasticity (JIS K6255) is not less than 20% at 10° C. and not more than 70% at 70° C.

The 300% modulus is not less than 200 kgf/cm$^2$ (JIS K6251).

The tear strength is not less than 35 kgf/cm$^2$ (JIS K6252 Crescent type).

The tension set is not more than 2.5% (JIS K6262), preferably not more than 1% and more preferably not more than 0.5%.

The contact pressure of the cleaning blade 3 to the photoreceptor PRy is in a range of from about 1.3 gf/mm to about 6.0 gf/mm.

In this case, only one cleaning blade 3 is provided in the rotating direction of the photoreceptor PRy in the present Example 1, but a plurality of cleaning blades can be provided as the case may be. Also, the cleaning blade 3 is not limited to the urethane rubber and may be formed of any elastic material if such elastic material has the above characteristics. In addition, the cleaning blade 3 can be employed as the cleaning blade for the intermediate transfer belt B.

In the cleaning blade 3, the prepolymer is generated by mixing diphenylmethane-4,4,-diisocyanate into the polytetramethyletherglycol, which is subjected to the dehydration process, and causing them to react for 15 minutes at 120° C., then both 1,4-butanediol and trimethylpropane as the curing agent are added into such prepolymer, and then the cross linking reaction is generated in the centrifugal molding machine to thus form the rubber sheet. In addition, the blade rubber material is formed by curing the rubber sheet for 10 hours at 110° C.

(Toner)

As the toners used in the developers Gy, Gm, Gc, Gk in Example 1, there is employed toner that is formed by adding externally three types of external additives, i.e., an external additive A (particular amorphous fine particle), an external additive B (monodisperse spherical silica), and an external additive C (small size organic compound), as the external additives and also several kinds of additives, which control the toner charge, into the almost spherical toner particulars.

The particles having shape factor SF less than 140 are used as the toner particle of the toner. Here, the shape factor SF is expressed by the following equation SF=[M$^2$/(A×

$4\pi)]\times100$ (where M is the maximum circumferential length of the particle, and A is the projected area of the particle).

In this case, it is desired that the shape factor SF of the toner particle should be set smaller. It is desired that, in order to improve the picture quality, preferably the spherical particle having the shape factor of not more than 135 should be employed, and more preferably the spherical particle having the shape factor of not more than 120 should be employed. If the shape factor SF is not less than 140, it is difficult to get the good transfer property like the toner whose toner particle is almost spherical, so that it is difficult to attain the higher picture quality of the resultant image.

Also, the particle whose volume mean particle diameter D is not less than 1 $\mu$m is used as the toner particle. It is preferable that the particle whose volume mean particle diameter D is 2 to 8 $\mu$m should be employed. If the volume mean particle diameter D becomes smaller than 1 $\mu$m, proper developing characteristic and cleaning characteristic cannot be obtained because the particle is too small. In contrast, if the volume mean particle diameter D exceeds 8 $\mu$m and becomes too large, the image becomes rough because the particle is too large, and thus such particle is disadvantageous to the higher picture quality of the image.

Also, the toner particle contains a binding resin, a coloring agent, and a release agent. The toner particle that contains the release agent resin in place of the release agent may be employed, otherwise the toner particle that does not contain both the release agent and the release agent resin may be employed.

The binding resin employed in the toner in the prior art may be employed as the binding resin, and the binding resin is not particularly limited.

More particularly, there may be listed styrene series such as styrene, parachlorostyrene, $\alpha$-methylstyrene; acrylic series monomer such as methyl acrylate, ethyl acrylate, n-propyl acrylate, lauryl acrylate, 2-ethylhexyl acrylate; methacrylic series monomer such as methyl methacrylate, ethyl methacrylate, n-propyl methacrylate, lauryl methacrylate, 2-ethylhexyl methacrylate; ethylene type unsaturated acid monomer such as acrylic acid, methacrylic acid, sodium styrene-sulfonate; vinylnitrile series such as acrylonitrile, methacrylonitrile; vinylether series such as vinylmethylether, vinylisobutylether; vinylketone series such as vinylmethylketone, vinylethylketone, vinylisopropenylketone; the homopolymer formed of the monomer of the olefin series such as ethyrene, propylene, butadiene, the copolymer formed of combination of two types of these monomers or more, or their mixture.

In addition, there may be listed the graft polymer that is obtained by polymerizing the nonvinyl condensed resin such as epoxy resin, polyester resin, polyurethane resin, polyamide resin, cellulosic resin, polyether resin, or the mixture with the vinyl resin, or the vinylmonomer under the coexistence of them into the homopolymer, the copolymer or the mixture.

The well-known coloring agent in the prior art can be employed every color toner as the coloring agent, and the coloring agent is not particularly limited. For example, various pigments such as carbon black, chrome yellow, Hansa yellow, benzidine yellow, thren yellow, quinoline yellow, permanent orange GTR, pyrozolone orange, vulcan orange, watchung red, permanent red, brilliant carmine 3B, brilliant carmine 6B, Dupon oil orange, pyrazolone red, lithol red, Rhodamine B lake, lake red C, rose Bengal, aniline blue, ultramarine blue, chalcoyl blue, methylene blue chlorite, phthalocyanine blue, phthalocyanine green, malachite green oxalate, or various dyes such as acridine series, xanthene series, azo series, benzoquinone series, azine series, anthraquinone series, thioindigo series, dioxazine series, thiazine series, azomethine series, indigo series, thioindigo series, phathalocyanine series, aniline black series, polymethine series, triphenylmethane series, diphenylmethane series, thiazine series, thiazole series, xanthene series, can be employed as one type or as the combination of two types.

The release agent or the release agent resin contained in the toner particle, if desired, may be added as a part of components of the above binding resin. Here, as the employed release agent, there may be listed the depolymerized polyolefin series such as polyethylene, polypropylene, polybutene; the fatty acid amid series such as silicon group, amide oleate, amide erucate, amide ricinolate, amide stearate; the plant wax such as camauba wax, rice wax, candelilla wax, Japan wax, jojoba oil; the animal wax such as beeswax; the mineral or petroleum wax such as montan wax, ozokerite, ceresin, paraffin wax, microcrystalline wax, Fisher-Tropsch wax, their denaturated substances. At least one type of them may be contained in the toner particle.

Also, in addition to the above components, various components may be contained in the above toner particle to control various characteristics. For example, if the toner is employed as the magnetic toner, the metal such as the magnetic powder (e.g., ferrite, magnetite), reduced iron, cobalt, nickel, manganese, the alloy, or compound containing these metals may be contained in the toner particle. In addition, as the case may be, the normally-used charge controlling agent such as quaternary ammonium salt, nigrosine compound, triphenylmethane pigment, may be appropriately contained selectively.

The method of obtaining the toner particle to satisfy the above conditions is not particularly restricted. For example, the dry high-speed mechanical impacting method of sphering the unshaped toner particles, which are selected by the normal grinding method, by the mechanical impact force to satisfy the above conditions, the wet melting sphering method of forming the toner particle by sphering the unshaped toners in the dispersion medium, the spherical toner manufacturing method of manufacturing the spherical toners by the known polymerization method such as the suspension polymerization, the disperse polymerization, the emulsion polymerization condensation method, can be employed.

The external additive A is the amorphous fine particle whose mean gain size is 2 to 5 $\mu$m and which has the plus polarity. Here, the material used for the amorphous fine particle is not particularly limited. For example, various components shown as the above binding resin can be employed. The desired amorphous fine particle can be prepared by the existing mechanical resin grinding method using these resin components or by the existing emulsifying method or dispersing method executed in the liquid medium such as the organic solvent. For example, the amorphous fine particle dispersed liquid, into which the amorphous fine particle of the present invention are dispersed, can be easily obtained by the polymerization method such as the emulsion polymerization method, the suspension polymerization method, the disperse polymerization method, in the heterogeneous disperse system. The amorphous fine particle dispersed liquid, into which the amorphous fine particles of the present invention are dispersed, can be obtained by any method such as the method of adding the polymers of the amorphous fine particles, which are uniformly polymerized in advance by the solution polymerization method, the bulk polymerization method, or the like, together with the stabilizer into the solvent, into which the polymer cannot be dissolved, and then mixed-dispersing them mechanically.

Also, the amorphous fine particles of the present invention can contain the lubricating fine grain. Here, the lubricant used in the present invention is employed to accelerate the slip between the cleaning member and the image carrying body such as the photoreceptor and reduce the friction between them. As the lubricant, there may be listed graphite, molybdenum disulfide, zinc stearate, calcium stearate, magnesium stearate.

Also, the above external additive B is the monodisperse spherical silica whose specific gravity is 1.3 to 1.9 and whose grain size is 80 to 300 nm. The monodisperse spherical silica having the grain size of 80 to 300 nm can be obtained by the wet sol-gel method. Since such monodisperse spherical silica is formed by the wet method without the burning, the specific gravity can be controlled lower than that obtained by the vapor phase oxidizing method. Also, the specific gravity can be further adjusted by controlling the hydrophobization process agent species or the processed amount in steps of the hydrophobization process. The grain size can be controlled freely by the weight ratio of alkoxysilane, ammonia, alcohol, and water, the reaction temperature, the stirring speed, and the supply speed in the sol-gel method while fixing the hydrolysis and the polycondensation. The monodisperse spherical shape can be achieved by forming the silica by virtue of the present approach.

More particularly, tetramethoxysilane is dropped in the water and the alcohol and then stirred using the aqueous ammonia as the catalyst while applying the temperature. Then, the centrifugal separation of the silica-sol suspension that is formed by the reaction is carried out to separate into the wet silica gel, the alcohol, and the aqueous ammonia. The solvent is added into the wet silica gel to get the silica sol again and then the hydrophobization of the silica surface is carried out by adding the hydrophobization process agent. The normal silane compound can be employed as the hydrophobization process agent. Then, the aimed monodisperse silica can be obtained by removing, drying, and seeping the solvent from the hydrophobization-processed silica sol. Also, the resultant silica may be processed again. The water-soluble type can be employed as the above silane compound. As such silane compound, the compound that is expressed by the chemical constitutional formula RaSiX4-a (where a is the integer of 0 to 3, R is the organic group such as hydrogen atom, alkyl group, alkenyl group, and X is the hydrolytic group such as chlorine atom, methoxy group, ethoxy group) can be employed and also any type of chlorosilane, alkoxysilane, silazane, and special silylation agent can be employed. More specifically, methyltrichlorosilane, dimethyldichlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltriethoxysilane, γ-methacryloxypropyltrimethoxysilane, β-(3,4-epoxycyclohexyl)ethyltrimethoxysilane, γ-glycidoxypropyltrimethoxysialne, γ-glycidoxypropylmethyldiethoxysilane, γ-mercaptopropyltrimethoxysilane, and γ-chloropropyltrimethoxysilane can be exemplified as the typical compound. As the processing agent in the present invention, particularly preferably there are dimethyldimethoxysilane, hexamethyldisilazane, methyltrimethoxysilane, isobutyltrimethoxysilane, decyltrimethoxysilane.

In addition, the above external additive C is the organic compound serving as the lubricant. As the typical compound, there may be listed polyolefin (product name Unilin), zinc stearate.

The material of the fine grain is not particularly restricted. The relatively good results can be attained by the inorganic oxide.

This fine grain can be prepared by the developing toner. In this case, the external additive ratio is that, if the toner particle and the condensed fine grains are set as 100 wt % in total, the fine grain is 0.3 to 10 wt %, preferably 0.5 to 5 wt % and more preferably 1 to 3 wt %. There is the tendency that the good lubricating effect of the cleaning blade cannot be sufficiently achieved if the externally added amount of the condensed particles is below 0.3 wt %, while there is the tendency that the charge characteristic and the fluidity characteristic as the toner are considerably damaged if such externally added amount exceeds 10 wt %.

Operation of Example 1

Since the cleaning blade having the above structure and having the modulus of repulsion elasticity of 20% at 10° C. and 40% at 40° C. is used in Example 1, the temperature dependency (variation) is small. In this case, if the cleaning blade 3 having the relatively high modulus of repulsion elasticity on the low temperature side is used to improve the cleaning characteristic in the low-temperature and low-humidity atmosphere, the modulus of repulsion elasticity on the high temperature side can be set to the relatively low value. As a result, since the material having the relatively high modulus of repulsion elasticity on the low temperature side can be employed, the cleaning performance can be assured unless the pushing force applied on the low temperature side is enhanced. Also, since the modulus of repulsion elasticity on the high temperature side is suppressed, the burr or the break of the cleaning blade 3 caused in the high-temperature and high-humidity atmosphere can be suppressed.

Also, the 300% modulus (JIS K6251) is 230 kgf/cm$^2$, and the tear strength (JIS K6252 crescent type) is 35 kgf/cm. In this manner, if the 300% modulus and the tear strength are high, the minute chip of the cleaning blade 3 can be suppressed. In particular, the cleaning performance in the high-temperature and high-humidity atmosphere can be improved, and the cleaning can be carried out without trouble by the almost spherical toners having shape factor (SF) less than 140.

Also, the cleaning blade 3 having the tension set (JIS K6262) of 2.5% is employed. Therefore, the reduction in the pushing force against the photoreceptors (PRy to PRk) is small even after the cleaning blade 3 is left as it is for a long time in the high-temperature and high-humidity atmosphere, and thus the cleaning performance can be assured.

Also, if the material of the cleaning blade 3 is selected as described above, the necessity for increasing the pushing force against the photoreceptors (PRy to PRk) and the intermediate transfer belt B to assure the cleaning performance can be eliminated. Thus, since the cleaning performance can be maintained in all application circumstances, the worn amount of the photoreceptors (PRy to PRk) and the intermediate transfer belt B can be reduced. In addition, in the situation that the friction coefficient of the surfaces of the photoreceptors (PRy to PRk) is increased because the discharge product is adhered onto the surfaces of the photoreceptors (PRy to PRk) or the surfaces thereof are changed in quality, the noise (creaking) due to the vibration of the cleaning blade 3 can be reduced.

Accordingly, if the maximum circumferential length of the toner particle is assumed as M and the projected area of the particle is assumed as A, the image with the high picture quality can be formed not to generate the defective cleaning even when the developing units (Gy to Gk) using the toners having shape factor SF expressed by $SF=[M^2/(A\times 4\pi)]\times 100$ is less than 140 are employed.

Explanation of Test Examples in Examples 1 to 6 and Comparative Examples 1 to 5

[Configuration of the Image Forming Apparatus]

Examples 1 to 6 and comparative Examples 1 to 5 of the cleaning blades shown in FIG. 3 to FIG. 6 described later are applied to the image forming apparatus shown in FIG. 1, and then various tests to be described later were made. Respective configurations of the image forming apparatus shown in FIG. 1 are given as follows.

Photosensitive drum: organic photosensitive material (ϕ=30 mm)

Process speed: 220 mm/sec, 110 mm/sec, 55 mm/sec

Charging unit: charging roller driven by AC-superposed DC

Developing unit: binary magnetic brush developing unit

Cleaning blade: polyurethane blade (length 8 mm, thickness 2 mm, contact angle 25 degree)

[Cleaning Characteristic Test]

The test was carried out by using the toners that are formed by the polymerization method, whose shape factor is distributed in the range of 123 to 128 and whose mean particle size is 6 μm, containing the binary developer containing the toners into the developers of the image forming apparatus, and watching the printed image and the photosensitive drum with respect to the cleaning result by the cleaning unit when the test print (the evaluation after the image having the area rate of 5% every color is printed by 50,000 sheets (50 kpv) while repeating the 5-sheet printing) is carried out by the image forming apparatus in the high-temperature and high-humidity (28° C., 85%RH) atmosphere, the low-temperature and low-humidity (10° C., 15%RH) atmosphere, and the middle-temperature and middle-humidity (22° C., 55%RH) atmosphere respectively. At the same time, it was checked whether or not the generation of the rough sound caused when the cleaning blade rubs the photoreceptor at respective speeds is present.

Evaluation items are given as follows.

(1) Cleaning performance (the stripe-like defect of the picture quality by the defective cleaning: the generation of the color stripe), (2) White streaks and the density reduction by the contamination of the charger (the generation of the image trouble due to the contamination of the charger by the fine grain at a submicron level), (3) Filming characteristic of the photosensitive drum (the film-like adhesion of the toner or the external additive onto the surface of the photosensitive drum by the contact of the cleaning blade), (4) Blade damage (the chip of the edge of the cleaning blade, or the burr of the blade itself), (5) Blade creaking (strange sound) when the photosensitive drum is rotated, and (6) Reduced amount of the film thickness of the surface layer of the photoreceptor (containing the picture quality variation by the change of the film thickness of the surface layer).

Evaluated results about the evaluation items are judged based on following criterions.

◎: the case where the symptoms of the evaluation object is not generated at a point of time when the test print of 50 kpv is ended, and it is predicted that the good result can be derived subsequently.

○: the case where the symptoms of the evaluation object is not generated at a point of time when the test print of 50 kpv is ended, but it is judged that the life has substantially expired at that time.

x: the case where the test print of 50 kpv could not be completed since the symptoms of the evaluation object is generated during the test print.

xx: the case where the symptoms of the evaluation object is generated at the initial stage (the test print stage of not more than 10 kpv).

In this case, obtained results are different depending on respective process speeds according to the evaluation items, but the worst result was selected as the evaluated result of the evaluation item if the different results were obtained. For example, if results of ○, x, and ○ are obtained with respect to a certain evaluation item at the process speeds of 220 mm/sec, 110 mm/sec, and 55 mm/sec respectively, the evaluation result is decided as x.

The evaluation result is decided as ◎ only if results of ◎ are obtained at all process speeds.

FIG. 3 is a table showing test results of cleaning characteristics with respect to the pushing force of the cleaning blade 3 and the blade material characteristics at 10° C., 25° C., 40° C.

In the table in FIG. 3, in the cleaning blade A in the comparative Example 1, in order to assure the cleaning performance in the low-temperature and low-humidity atmosphere, the pushing force of the cleaning blade against the photoreceptor must be increased. However, there is the problem that, if the pushing force is increased, the worn amount of the surface layer of the photoreceptor is increased and thus the life of the photoreceptor is shortened (see the comparative Example 1). Also, in the cleaning blade B (which has the large modulus of repulsion elasticity in the low-temperature and low-humidity atmosphere) in the comparative Example 2, the burr is generated at the top end portion of the cleaning blade in the high-temperature and high-humidity atmosphere.

In other words, if the cleaning blade having the large modulus of repulsion elasticity on the low temperature side is employed to increase the cleaning performance in the low-temperature and low-humidity atmosphere, the modulus of repulsion elasticity on the high temperature side is also increased and thus the turned-up blade or the broken blade is generated. In order to suppress the turned-up blade or the broken blade in the high-temperature and high-humidity atmosphere, the modulus of repulsion elasticity on the high temperature side must be suppressed. That is, if the modulus of repulsion elasticity on the low temperature side is increased and also the modulus of repulsion elasticity on the high temperature side is decreased, the cleaning characteristic can be assured from the low-temperature and low-humidity atmosphere to the high-temperature and high-humidity atmosphere (cleaning blade C (Example 1)).

[Settling Performance Test of the Blade]

FIG. 4 is a table showing test results of the pushing force after the settling test and cleaning characteristics (defective cleaning) with respect to the tension set (JIS K6262) after the settling test of the cleaning blade 3 is executed.

The settling amount denotes the permanent deformation of the cleaning blade 3. That is, the cleaning blade 3 is held for a long period in the high-temperature and high-humidity atmosphere in the state that the cleaning blade 3 is pushed against the photoreceptor PRy to deform to some extent and generate the pushing force, and then the cleaning blade 3 cannot be restored to the original state and thus the permanent deformation is caused. The value indicating to what extent the cleaning blade 3 is deformed from the original state is the settling amount.

In the settling performance test of the cleaning blade 3, the photosensitive unit being constructed such that the defined pushing force of the cleaning blade 3 against the photoreceptor PRy can be obtained is employed. That is, the above photosensitive unit is left as it is in the thermohygrostat bath. At this time, the conditions of the temperature, the humidity, and the leaving time are set to 45° C., 95%RH, and 72 hours respectively. Then, the unit having the photoreceptor and the cleaning blade is installed into the image forming apparatus, then the short-running of 1 kpv is executed, and then the evaluations are carried out at respective process speeds and respective atmospheres. As the evaluation items, only the cleaning performance explained in the items of the cleaning characteristic test (the stripe-like picture quality defect due to the defective cleaning: the generation of the color stripe) is used.

Results are judged based on following criterions. The results are shown in FIG. 4.

◎: the case where the symptoms of the evaluation object is not generated at a point of time when the test print of 1 kpv is ended, and it is predicted that the good result can be derived subsequently.

○: the case where the symptoms of the evaluation object is not generated at a point of time when the test print of 1 kpv is ended, but it is judged that the life has substantially expired at that time.

x: the case where the test print of 1 kpv could not be completed since the symptoms of the evaluation object is generated during the test print.

xx: the case where the symptoms of the evaluation object is generated at the initial stage (the test print stage of not more than 100 kpv).

In this case, as the evaluation results obtained when results are different according to the process speeds, the worst result is employed as the evaluation result, like the case of the above cleaning characteristic test.

In the table in FIG. 4, if the tension set is set to not more than 2.5% in contrast to 3.8% of the comparative blade (see Examples 1, 2, 3), the cleaning performance can be assured after the cleaning blade is left for a long term as it is in the high-temperature and high-humidity atmosphere. If the tension set exceeds 2.5% (see Example 4), the pushing force against the photoreceptor PR is lowered and thus the defective cleaning is generated. In the blade C whose numerical value of the tension set is 2.5% (see Example 1), such a prediction result (the evaluation result=○) was derived that the cleaning performance can be assured up to 1 kpv in the running test after the settling test but the subsequent cleaning performance cannot be assured. In contrast, in the blade D2 whose numerical value of the tension set is not more than 1.0% (see Example 3), such a result (the evaluation result=◎) was exhibited that the cleaning performance can be assured in excess of 1 kpv in the high-temperature and high-humidity atmosphere. Further, in the blade D1 whose numerical value of the tension set is not more than 0.5% (see Example 2), such a result (the evaluation result=◎) was exhibited that the cleaning performance can be assured in excess of 1 kpv in all tested atmospheres.

In this case, since the tension set exceeds 2.5% in Example 4, the cleaning performance could not be assured after the blade settling performance test. But the above cleaning characteristic test shows the good result.

[Generation of the Blade Damage and Cleaning Characteristic Test with Respect to the Modulus of Repulsion Elasticity, the 300% Modulus, and the Tear Strength of the Cleaning Blade]

FIG. 5 and FIG. 6 are tables showing test results of cleaning characteristics with respect to the modulus of repulsion elasticity, the 300% modulus, and the tear strength of the cleaning blade 3.

In FIG. 5 and FIG. 6, it is understood that, in the cleaning blade whose modulus of repulsion elasticity is 70% at 40° C., the blade damage such as the chip, is not generated and the cleaning performance is good if the 300% modulus is not less than almost 200 kgf/cm$^2$ and the tear strength is not less than almost 35 kgf/cm. In the blade A in the comparative Example 1, the 300% modulus is particularly high and also the tear strength exceeds 35 kgf/cm. In addition, since the modulus of repulsion elasticity is below 70% at 40° C., the blade damage exhibits the very good result. However, because the modulus of repulsion elasticity at 10° C. is low, the cleaning performance is poor and thus the defective cleaning or the filming is generated, so that such blade cannot stand the practical use. Also, because the tension set is large, the defective cleaning is caused if the stress conditions are applied such that the blade is left for a long time as it is in the high-temperature and high-humidity atmosphere, so that such blade cannot stand the practical use.

In the blade B in the comparative Example 2, since the 300% modulus is below 200 kgf/cm$^2$ and the tear strength does not satisfy 35 kgf/cm, the blade damage is caused. Because the modulus of repulsion elasticity is high such as 75% in the high-temperature and high-humidity atmosphere (28° C., 85%RH), the blade damage becomes worse especially in the high-temperature and high-humidity atmosphere.

In the blade C of Example 1 of the present invention, the modulus of repulsion elasticity at 40° C. is 70%, but the 300% modulus exceeds 200 kgf/cm$^2$ and also the tear strength is 35 kgf/cm. Therefore, the generation of the blade damage exhibited the very good result.

From the results of the cleaning blades F, G in the comparative Examples 3, 4 and the cleaning blades in the Examples 5, 6, it is found that, unless both conditions that the 300% modulus is not less than 200 kgf/cm$^2$ and the tear strength is not less than 35 kgf/cm are satisfied, the generation of the blade damage such as the broken blade, is brought about.

In addition, it is found that, if the above conditions are satisfied but the modulus of repulsion elasticity at 40° C. exceeds 75%, the generation of the blade damage such as the broken blade, etc. is also brought about. That is, the suppression of the high modulus, the high tear strength, and the modulus of repulsion elasticity at 40° C. can suppress the blade damage.

If the material of the cleaning blade is selected with regard to the above characteristics, such a necessity can be eliminated that the pushing force against the photoreceptor should be increased to assure the cleaning performance. Therefore, the cleaning performance can be assured in all application atmospheres, and thus the worn amount of the photoreceptor can be reduced.

[Test Results of the Cleaning Characteristics with Respect to Various Toners Having the Different Shape Factors]

FIG. 7 is a table showing the toner slipping-through states of the cleaning blades in the prior art and the cleaning blades of the present invention with respect to various toners that have the different shape factors.

In other words, FIG. 7 shows the results obtained when the image that has the image area coverage of 100% (normally called the solid image) and has the length of 1000 mm is developed onto the photoreceptor in the low-temperature and low-humidity atmosphere, while using the photoreceptor to which 50 kpv (the 50 k print volume, i.e., the 50000 sheet printing) has been applied, the unused cleaning in the prior art or the present Example, and various toners having the different shape factors in combination in the cleaning characteristic test, and then the number of the toners (defective cleanings) that are passed through the cleaning blade is counted by stopping the drive of the photoreceptor immediately after the image is passed, under the condition that the photoreceptor is cleaned not to transfer onto the transfer material.

In the table in FIG. 7, the slipping-through denotes the number of the toners that slip through the cleaning blade on the photoreceptor to cause the defective cleaning.

As can be seen from the table in FIG. 7, in the cleaning blades (comparative Examples 1 to 5) in the prior art, the generation situation of the defective cleaning becomes worse as the SF (shape factor) value become smaller. In contrast, it is understood that, in the cleaning blades (Examples 1 to 6) of the present invention, the photoreceptor can be cleaned irrespective of the shape factor of the toners. The reason for this may be considered as follows.

That is, if the shape factor of the toner exceeds 140, the toner shape becomes indefinite and thus ruggedness (unevenness) of the toner surface becomes conspicuous. Since such ruggedness (unevenness) increases the number of the contact points when the toners come into contact with the surface of the image carrying body, it is difficult for the toners to roll on the image carrying body. That is, when the toners are moved by the rotating movement of the image carrying body to strike against the cleaning blade, such toners are slid on the surface of the image carrying body by the above action to move. Therefore, the toners do not enter into minute clearances of the cleaning blade, nevertheless the toners can be simply scraped away from the surface of the image carrying body by the cleaning blade.

Conversely, if the shape factor of the toner is not more than 120, the almost spherical toner particle can be formed. Therefore, the contact point between the toner and the surface of the image carrying body becomes almost one point and thus the toners are ready to roll on the image carrying body. That is, when the toners are moved by the rotating movement of the image carrying body to strike against the cleaning blade, the toners are ready to roll. Thus, even when the minute clearances are generated between the cleaning blade and the image carrying body because of the scratch of the image carrying body after the lapse of time, the wear of the cleaning blade, the toner particles are rolled to slip through such clearances. In particular, if the toner being called the small particle size, that is not more than 7 $\mu$m, and the cleaning blade having the characteristics of the comparative examples are employed, the generation of such slipping-through of the toners becomes remarkable.

Also, normally it is well known that, if the same particle size is employed, the transfer from the image carrying body to the transfer paper can be made most effectively when the almost spherical toner particle whose SF (shape factor) is not more than 120 is used, then the efficiency is lowered as the shape factor is increased, and then the efficiency is largely lowered when the size of the toner particle enters into the indefinite area in which the shape factor exceeds 140. Similarly, it is well known that, if the same shape is employed, the transferring characteristic can be improved when the toner particle size becomes larger. In addition, it is well known that, as described above, normally the picture quality can be improved when the transferring performance becomes higher and the efficiency becomes higher, and also the picture quality can be improved when the particle size becomes smaller.

As evident from the test results shown in the table in FIG. 7 and the well-known facts, if the transfer efficiency is enhanced by the small particle size, such high transfer efficiency is advantageous to the higher picture quality but is disadvantageous to the cleaning characteristic of the residual transfer toners. Also, the residual transfer toners are often charged in the opposite polarity by the influence of the transfer electric field, and also have the conditions that are electrically disadvantageous other than the above action. However, the above cleaning blades in Examples 1 to 6 of the present invention can enhance the cleaning performance of the toners and can achieve the higher picture quality of the resultant image not to change the system, which is used commonly, of the image forming apparatus and not to increase the cost. Also, the cleaning blades of the above Examples can be used to clean the intermediate transferring body.

Figure 8:
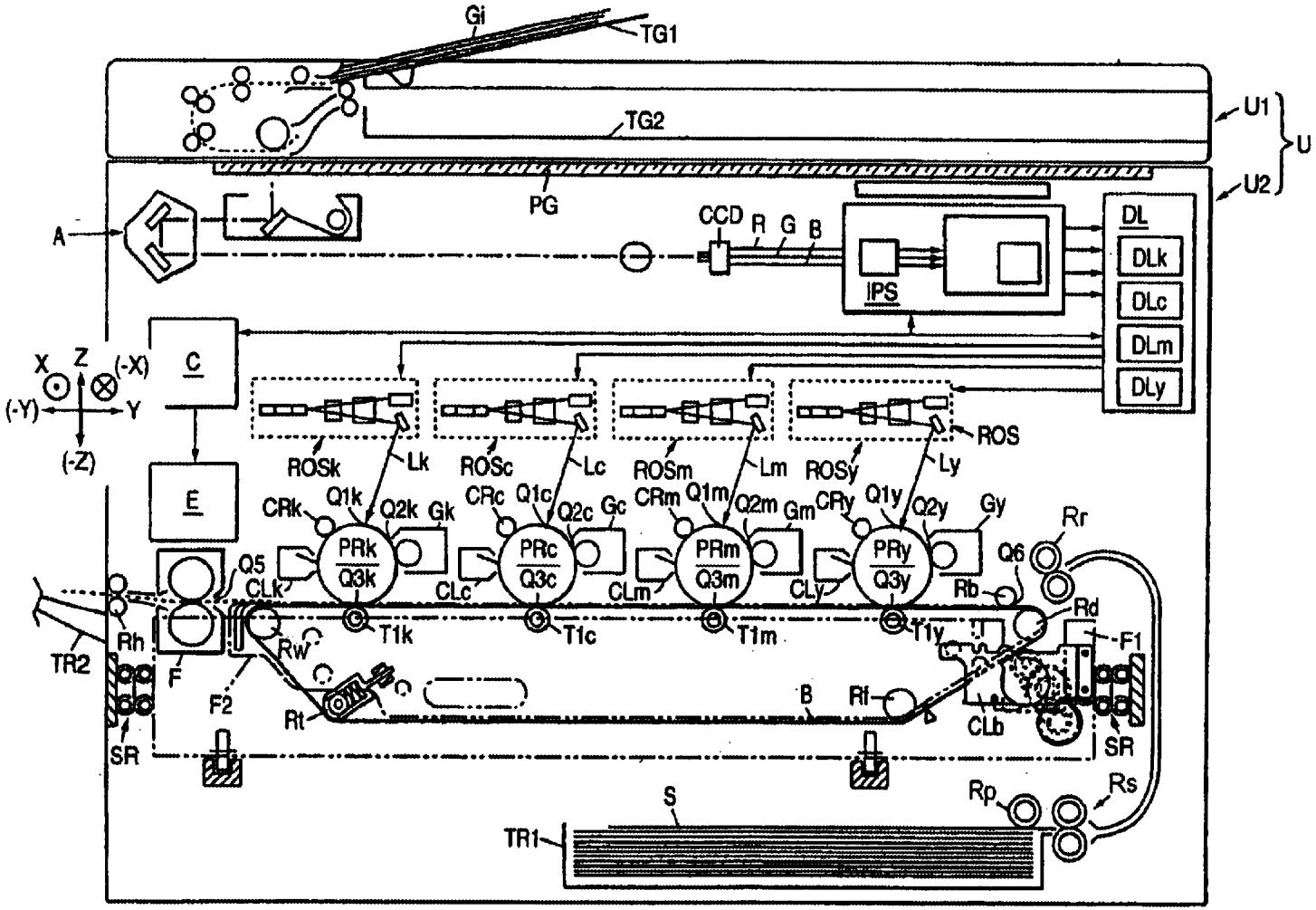
FIG. 8 is a sectional view of another example of the image forming apparatus that employs the cleaning blades (3) in above Examples 1 to 6.

FIG. 8 is a sectional view of another example of the image forming apparatus employing cleaning blades in above Examples 1 to 6.

In this case, in the explanation of the image forming apparatus shown in FIG. 8, the detailed explanation will be omitted by affixing the same symbols to the constituent elements that correspond to the constituent elements of the image forming apparatus in above Example 1.

In FIG. 8, a moving table F1 (indicated by a chain double-dashed line) is supported below the image carrying bodies PRk to PRc slidably in the back and forth direction (direction perpendicular to the sheet) by a pair of moving table slide rails SR, SR. A belt module (vertically moving member) F2 is supported vertically movably to the moving table F1.

The belt module F2 has the sheet carrying belt B, the belt supporting rollers (Rd, Rt, Rw, Rf) containing the belt driving roller Rd, the tension roller Rt, the walking roller Rw, and the idle roller (free roller) Rf, the transferring rollers T1*k*, T1*y*, T1*m*, T1*c*, and the sheet carrying belt cleaner CLb. Then, the sheet carrying belt B is supported rotatably by the belt supporting rollers (Rd, Rt, Rw, Rf).

In FIG. 8, the state that the belt module F2 is held at the lifting position (the position at which the sheet carrying belt B contacts to lower surfaces of the image carrying bodies PRk to PRc) is shown. When the moving table F1 is moved back and forth to install into or release from the image forming apparatus main body U1, the belt module F2 is held at the descending position (the position at which the sheet carrying belt B is remote downward from the image carrying bodies PRk to PRc). As a result, when the moving table F1 and the belt module F2 supported by this moving table F1 are attached to and detached from the image forming apparatus main body, the belt module F2 is constructed not to frictionally contact to the image carrying bodies PRk, PRy, PRm, PRc.

The configuration for moving the moving table F1 back and forth and the configuration for moving vertically the belt module F2 is known in the prior art (for example, see Patent Application Publication (KOKAI) Hei 8-171248). Various configurations known in the prior art can be employed.

The recording sheet S in the paper feed tray TR1 arranged below the sheet carrying belt B is taken out by the pickup roller Rp, then separated one by one by the separating roller Rs, and then fed to the registration roller Rr. The registration roller Rr carries the recording sheet S to a sheet sucking position Q6 at predetermined timings. A sucking roller Rb is arranged at the sheet sucking position Q6 to cause the sheet carrying belt B to electrostatically suck the recording sheet S.

The recording sheet S being sucked by the sheet carrying belt B are passed sequentially through the transferring areas Q3*k*, Q3*y*, Q3*m*, Q3*c*, that come into contact with the image carrying bodies PRk to PRc.

The transfer voltage having the polarity opposite to the charged polarity of the toners is applied to the transfer rollers T1*k*, T1*y*, T1*m*, T1*c*, which are arranged on the back side of the sheet carrying belt B in the transferring areas Q3*k*, Q3*y*, Q3*m*, Q3*c*, from the power supply circuit E, which is controlled by the controller C, at predetermined timings.

In the case of the color image, the toner images on the image carrying bodies PRk to PRc are transferred onto the recording sheet S on the sheet carrying belt B by the transferring rollers T1*k*, T1*y*, T1*m*, T1*c* to overlap with each other. Also, in the case of the monochromatic image, only the K (black) toner image is formed on the image carrying body PRk, and then only the K (black) toner image is transferred onto the recording sheet S by the transfer unit T1*k*.

The recording sheet S on which the toner image is transferred is released from the sheet carrying belt B by a releasing pawl (not shown), then fixed by the fixing unit F when passed through the fixing area Q5, and then discharged from the discharge roller Rh to the paper discharge tray TR2.

After the recording sheet S is released, the sheet carrying belt B is cleaned by the sheet carrying belt cleaner CLb.

The sheet carrying belt cleaner CLb is constructed similarly to the belt cleaner CLb shown in FIG. 2, and has the cleaning blade 3 in Example 1 as the cleaning blade 3. In this case, the cleaning blade 3 in respective Examples 2 to 6 can be employed as the cleaning blade 3.

In the image forming apparatus having the above configuration shown in FIG. 8, since the cleaning blade 3 in Example 1 is employed, there is no necessity that the pushing force against the sheet carrying belt must be increased to assure the cleaning performance, and the worn amount of the sheet carrying belt can be reduced since the cleaning performance can be assured in all application atmospheres. Accordingly, even if the developing units (Gy to Gk) using the toners having shape factor less than 140 are employed, the image with the high picture quality can be formed without the generation of the defective cleaning.

(Variation)

The examples of the present invention are described in detail as above. But the present invention is not limited to above examples and can be varied variously within the range of the gist of the present invention set forth in claims. Variations of the present invention are given in the following.

(1) The present invention can be applied to not only the image forming apparatus, in which the toner image formed on the photoreceptors PRy to PRk is transferred onto the intermediate transfer belt (transfer material) B and then transferred onto the recording sheet (transfer material) S, but also the image forming apparatus in which the toner image formed on the photoreceptors PRy to PRk is transferred directly onto the recording sheet S.

(2) The belt cleaner CLb of the present invention can be applied to not only the photoreceptor cleaner CLy but also the secondary transferring unit cleaner that cleans the toners adhered onto the surface of the secondary transfer roller T2*b*.

(3) The present invention can be employed in not only the tandem image forming apparatus, which has a plurality of photoreceptors, but also the rotary-type image forming apparatus, which has one photoreceptor, and also the image forming apparatus that has the member to be cleaned.

(4) The present invention can be employed in not only the intermediate transfer belt B but also the roller type intermediate transfer belt.

The present invention having the above configuration can achieve a following advantage (1).

(1) It is possible to provide a cleaning blade, a cleaner, and an image forming apparatus, which are capable of preventing sufficiently the defective cleaning of almost spherical toners without fail from the low-temperature and low-humidity atmosphere to the high-temperature and high-humidity atmosphere.

What is claimed is:

1. A cleaning blade comprising a blade top end portion for frictionally contacting with a surface of an image carrying body to remove residual toners on the surface when the surface passes through a cleaning area, wherein the cleaning blade is made of elastic material;

wherein the cleaning blade is formed of urethane rubber;

wherein a modulus of repulsion elasticity (JIS K6255) of the cleaning blade is not less than 20% at 10° C. and not more than 70% at 40° C.;

wherein a 300% modulus (JIS K6251) of the cleaning blade is not less than 200 kgf/cm$^2$; and wherein a tear strength (JIS K6252 crescent type) of the cleaning blade is more than 35 kgf/cm.

2. The cleaning blade according to claim 1, wherein a tension set (JIS K6262) is not more than 2.5%.

3. A cleaner for cleaning an image carrying body, comprising a cleaning blade having a blade top end portion for frictionally contacting with a surface of the image carrying body to remove residual toners on the surface when the surface passes through a cleaning area, wherein the cleaning blade is made of elastic material;

wherein the cleaning blade is formed of urethane rubber;

wherein a modulus of repulsion elasticity (JIS K6255) of the cleaning blade is not less than 20% at 10° C. and not more than 70% at 40° C.;

wherein a 300% modulus (JIS K6251) of the cleaning blade is not less than 200 kgf/cm$^2$;

wherein a tear strength (JIS K6252 crescent type) of the cleaning blade is more than 35 kgf/cm; and wherein the cleaning blade removes a toner adhering to the surface of the image carrying body on which a toner image is formed.

4. An image forming apparatus comprising:

a photoreceptor;

a charging unit;

an electrostatic latent image forming unit;

a developing unit;

a transferring unit; and a photoreceptor cleaner, wherein the photoreceptor passes through a charging area in which a surface thereof is charged, a latent image writing position in which a light is irradiated thereto in response to an image, a developing area opposing to the developing unit, a transferring area, and a cleaning area sequentially;

wherein the charging unit charges a surface of the photoreceptor passing through the charging area;

wherein the electrostatic latent image forming unit forms an electrostatic latent image on the surface of the charged photoreceptors passing through the latent image writing position;

wherein the developing unit develops the electrostatic latent image on the surface of the photoreceptor passing through the developing area into a toner image;

wherein the transferring unit transfers the toner image on the surface of the photoreceptor passing through the transferring area onto a transfer material;

wherein the photoreceptor cleaner comprises a cleaning blade and cleans a toner adhered to the surface of the photoreceptor on which the toner image is formed by the cleaning blade;

wherein the cleaning blade comprises a blade top end portion for frictionally contacting with the surface of the photoreceptor to remove the toner adhering to the surface of the photoreceptor when the surface passes through the cleaning area;

wherein the cleaning blade is made of elastic material;

wherein the cleaning blade is formed of urethane rubber;

wherein a modulus of repulsion elasticity (JIS K6255) of the cleaning blade is not less than 20% at 10° C. and not more than 70% at 40° C.;

wherein a 300% modulus (JIS K6251) of the cleaning blade is not less than 200 kgf/cm$^2$; and wherein a tear strength (JIS K6252 crescent type) of the cleaning blade is more than 35 kgf/cm.

5. An image forming apparatus comprising:

a photoreceptor;

a charging unit;

an electrostatic latent image forming unit;

a developing unit;

an intermediate transferring body;

a primary transferring unit;

a secondary transferring unit; and an intermediate transferring body cleaner, wherein the photoreceptor passes through a charging area in which a surface thereof is charged, a latent image writing position in which a light is irradiated thereto in response to an image, a developing area opposing to the developing unit, a primary transferring area, and a photoreceptor cleaning area sequentially;

wherein the charging unit charges the surface of the photoreceptors passing through the charging area;

wherein the electrostatic latent image forming unit forms an electrostatic latent image on the surface of the charged photoreceptor passing through the latent image writing position;

wherein the developing unit develops the electrostatic latent image on the surface of the photoreceptor passing through the developing area into a toner image;

wherein the intermediate transferring body passes through the primary transferring area in which the intermediate transferring body comes into contact with the surface of the photoreceptor and the toner image on the surface of the photoreceptor is primarily transferred thereonto, a secondary transferring area in which the toner image being primarily transferred is secondarily transferred onto a recording sheet, and the intermediate transferring body cleaning area in which a surface thereof is cleaned sequentially;

wherein the primary transferring unit transfers the toner image on the surface of the photoreceptor passing through the primary transferring area onto the intermediate transferring body;

wherein the secondary transferring unit transfers the toner image on a surface of the intermediate transferring body passing through the secondary transferring area onto the recording sheet;

wherein the intermediate transferring body cleaner has a cleaning blade and cleans a toner adhering to the surface of the intermediate transferring body by the cleaning blade in the intermediate transferring body cleaning area;

wherein the cleaning blade comprises a blade top end portion for frictionally contacting with the surface of the photoreceptor to remove the toner adhering to the surface when the surface passes through the cleaning area;

wherein the cleaning blade is made of elastic material;

wherein the cleaning blade is formed of urethane rubber;

wherein a modulus of repulsion elasticity (JIS K6255) of the cleaning blade is not less than 20% at 10° C. and not more than 70% at 40° C.;

wherein a 300% modulus (JIS K6251) of the cleaning blade is not less than 200 kgf/cm$^2$; and wherein a tear strength (JIS K6252 crescent type) of the cleaning blade is more than 35 kgf/cm.

6. The image forming apparatus according to claim 4, wherein the developing unit employs a toner having shape factor SF less than 140;

wherein the shape factor SF is expressed by $$SF=[M2/(A\times 4\pi)]\times 100$$

where M is a maximum circumferential length of a toner particle and A is a projected area of the toner particle.

7. The image forming apparatus according to claim 5, wherein the developing unit employs a toner having shape factor SF less than 140;

wherein the shape factor SF is expressed by $$SF=[M2/(A\times 4\pi)]\times 100$$

where M is a maximum circumferential length of a toner particle and A is a projected area of the toner particle.

* * * * *